United States Patent [19]

Weinzinger et al.

[11] Patent Number: 4,457,149

[45] Date of Patent: Jul. 3, 1984

[54] APPARATUS FOR PRODUCING COILS OF METAL STRIP

[75] Inventors: Hans J. Weinzinger; Rudolf Pichler, both of Linz, Austria

[73] Assignee: Veest-Alpine Aktiengesellschaft, Linz, Austria

[21] Appl. No.: 351,650

[22] Filed: Feb. 24, 1982

[30] Foreign Application Priority Data

Mar. 26, 1981 [AT] Austria ..... 1404/81

[51] Int. Cl.[3] ..... B21C 19/00; B21C 47/02; B21D 1/02; B21D 1/05

[52] U.S. Cl. ..... 72/10; 72/146; 72/161; 72/166; 72/205

[58] Field of Search ..... 72/10, 11, 12, 17, 146, 72/148, 160, 161, 205, 702, 166, 169; 242/55

[56] References Cited

U.S. PATENT DOCUMENTS

| | | | |
|---|---|---|---|
| 3,401,546 | 9/1968 | Greenberger | 72/205 X |
| 3,559,431 | 2/1971 | Noe et al. | 72/10 X |
| 3,777,532 | 12/1973 | Noe | 72/205 |
| 3,806,574 | 4/1974 | Arvidson | 242/55 X |
| 3,839,888 | 10/1974 | Greenberger | 72/205 X |
| 3,924,428 | 12/1975 | Noe | 72/205 X |
| 3,962,894 | 6/1976 | Noe et al. | 72/205 X |
| 4,134,283 | 1/1979 | Noe | 72/205 X |
| 4,339,934 | 7/1982 | Mitchell | 72/17 |

FOREIGN PATENT DOCUMENTS

| | | | |
|---|---|---|---|
| 358900 | 2/1980 | Austria . | |
| 908004 | 4/1954 | Fed. Rep. of Germany . | |
| 2203911 | 8/1973 | Fed. Rep. of Germany | 72/10 |
| 92826 | 1/1969 | France . | |

*Primary Examiner*—E. Michael Combs
*Attorney, Agent, or Firm*—Kurt Kelman

[57] ABSTRACT

To permit a planar strip to be unwound from a reel, the strip to be coiled up has imparted to it a progressively decreasing curvature in a sense which is opposite to the longitudinal curvature of the coiled strip.

2 Claims, 1 Drawing Figure

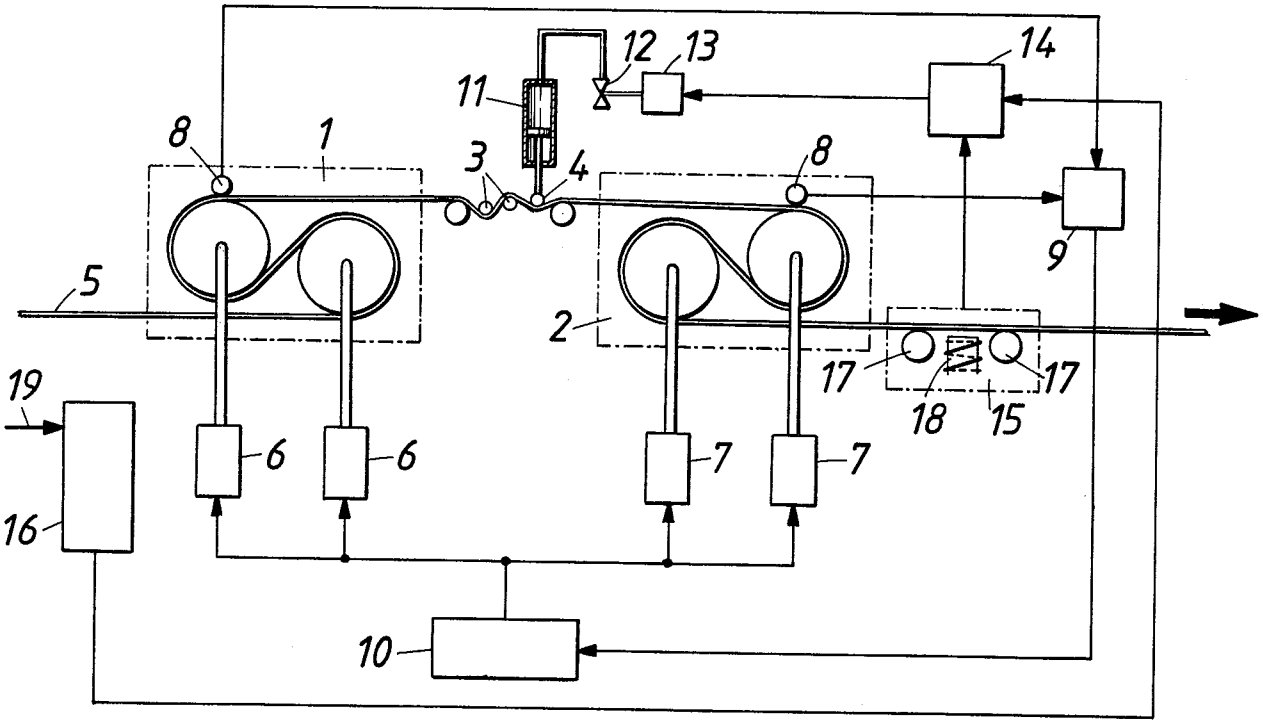
1
2
3
4
5
6
7
8
9
10
11
12
13
14
15
16
17
18
19

APPARATUS FOR PRODUCING COILS OF METAL STRIP

When planar metal strip, which has been straightened, is coiled up on a reel, it is subjected to a bending stress, which depends on the coil diameter, on the properties of the material and on the tension of the strip and which has the result that the neutral line of the inherent stresses in the strip, which neutral line lies at the center of the strip after the straightening operations, will be displaced from the center so that the strip will develop a curvature in its longitudinal direction as the strip is wound. For this reason the strip must be straightened once more before it can be processed. It is known from German Pat. No. 908,004 to provide for this purpose a bending roller or a bending drum, which succeeds the reel and around which the strip being wound is bent in a sense which is opposite to the sense in which it has been curved as it was coiled up.

It is an object of the invention to provide for the coiling up of straightened metal strip a process which eliminates the need for such a restraightening of the strip because the neutral line of the inherent stresses in the strip being unwound is disposed at the center of the strip.

This object is accomplished according to the invention by imparting to the strip to be coiled up a progressively decreasing longitudinal curvature in a sense which is opposite to the longitudinal curvature of the coiled strip.

By this bending of the strip before it is coiled up, the neutral line of the inherent stresses remaining in the strip after the straightening operation is displaced from the center of the strip to such an extent that the bending of the strip as it is wound will cause the neutral line of said inherent stresses to return to the neutral zone of the strip so that the metal strip which has been unwound will be planar and need not be re-straightened. Because the curvature imparted to the strip decreases as the coil diameter increases, the longitudinal curvature imparted to the strip to be coiled up must decrease as the coil diameter increases if a planar shape of the unwound strip is to be ensured.

From French Pat. No. 1,468,856 it is known that the partial strips of a longitudinally slitted metal strip can be coiled up on a common reel if the partial strips, which are supplied to the reel under no tension, are caused to move through a snubber before they are delivered over two guide rollers to the reel. Because the partial strips move around the guide rollers in S-shape, the partial strips to be coiled up are bent in a sense that is opposite to the curvature of the coiled strips. But this bending will not influence the curvature imparted to the strip as it is coiled up because the movement of the partial strips along an S-shaped path will not displace the zero line of the inherent stresses.

To straighten a wavy strip, the fibers in the non-wavy portions of the strip must be stretched to the length of the fibers in the waves. For this reason the length difference between the fibers in the wavy and non-wavy portions of the strip will determine the smallest degree of elongation which is required to obtain a planar strip and which will result in the least change of the properties of the material. To eliminate the need to stretch all portions of a metal strip to a degree of elongation which would correspond to the largest waviness of the strip, a stretching and bending apparatus has been disclosed (in Austrian Pat. No. 358,900), in which the degree of elongation between the sets of tensioning rollers acting on the strip to be straightened is controlled in dependence on the waviness of the strip. The changing degree of elongation results in a displacement of the neutral line of the inherent stresses remaining in the strip so that the resulting longitudinal curvature of the strip must be eliminated by a suitable control. For that purpose a positioning drive is provided to control the position of engagement of the straightening roller, which succeeds the bending rollers and serves to compensate such curvature, and the positioning drive is controlled by a controller, which is supplie from an actual-value signal generator with a signal representing the actual value of the detected transverse curvature of the strip. As the transverse curvature of tensioned strip is related to the longitudinal curvature which is developed by the strip when it is free to spring back, the control to eliminate the longitudinal curvature can actually be effected in dependence on the detected amplitude of the transverse curvature of the strip.

In accordance with the invention the strip which is to be coiled up on a reel is to be given a longitudinal curvature which is opposite to the curvature imparted to the strip as it is coiled up. Whereas the known stretching and bending straightening apparatus can compensate any longitudinal curvature by an additional bending operation, the process according to the invention can be carried out by an apparatus which has been developed from said known stretching and bending apparatus. If the known apparatus is to impart an appropriate longitudinal curvature to the strip to be coiled up, the known apparatus must be modified by connecting the controller to a desired-value signal generator, which consists of a computer, by which that transverse curvature of the strip that corresponds to the required longitudinal curvature of the strip to be coiled up is computed in accordance with a program in dependence on the changing coil diameter, of the properties of the material and the tension of the strip. In dependence on the desired-value signal delivered by the computer, the position of engagement of the straightening rollers is controlled so as to eliminate any difference between the desired and actual values in order to ensure that the neutral line of the inherent stresses remaining in the straightened strip will not move to the neutral zone of the strip as it is coiled up but will be displaced from said neutral zone to such an extent that the subsequent coiling up of the strip will necessarily result in such a bending of the strip in its longitudinal direction that the neutral line of the inherent stresses of the strip will be displaced into the neutral zone. The dependence of that previous bending on the coil diameter can readily be taken into account by the computer in that the latter is fed with data indicating the instantaneous coil diameter; such data can be obtained from a suitable measuring instrument. It will be understood that the properties of the strip material and the tension of the strip must also be taken into account as the curvature imparted to the strip as it is coiled up will depend also on these parameters. As the mathematical relationship of these parameters has been ascertained only with the aid of simplifying theoretical models, a correction based on empirical values will usually be required. Such corrections can easily be provided for in a suitable computer program.

The process for coiling up straightened metal strip will now be explained more fully with reference to the accompanying drawing, which is a block circuit diagram showing a plant which embodies the invention and serves to impart a longitudinal curvature to metal strip which is to be coiled up.

The stretching and bending straightening apparatus shown on the drawing comprises two sets of tensioning rollers 1 and 2. Two bending rollers 3 and a straightening roller 4, which succeeds the bending rollers, are disposed between the tensioning rollers 1 and 2. The sets of tensioning rollers 1 and 2 serve to apply to the strip 5 a tension, which is controlled by the drive means 6 and 7 for the sets of tensioning rollers 1 and 2. The speeds of the incoming and outgoing strip 5 are sensed by sensing rollers 8 and are delivered to an actual-value signal generator 9 which, in dependence on the differential speed, generates a signal that represents the actual degree of elongation of the strip. That actual-value signal is delivered to the controller 10, which controls the drive means 6 and 7 in dependence on a difference between the desired and actual values. The desired degree of elongation may be a preselected, constant value or may be restricted to the required minimum value that is required in view of the waviness of the strip; in the latter case the desired-value must be controlled to serve as a command variable.

To control the position of the neutral line of the inherent stresses remaining in the strip which has been straightened relative to the neutral zone of the strip, the position of engagement of the straightening roller 4 with the strip 5 is controlled by a positioning drive 11 which, in the embodiment shown, consists of a hydraulic cylinder. The application of force to that positioning drive 11 may be controlled by a valve 12, which may be actuated, e.g., by a solenoid 13, in dependence on the output of a controller 14. The latter has an input terminal connected to an actual-value signal generator 15, which succeeds the downstream set of tensioning rollers 2 and detects the amplitudes of transverse curvatures of the strip, and another input terminal connected to a computer 16, which delivers a desired-value signal.

The actual-value signal generator 15 comprises two backing rollers 17 for engaging the strip 5 and a plurality of solenoids 18, which are disposed under and distributed across the width of the strip and subject the strip to forces which are approximately normal to the surface of the strip. The deflection of the strip 5 between the two backing rollers 17 will determine the width of the air gap between the strip 5 and the solenoids 18 so that the voltage across the exciter winding will be a measure of the varying deflection of the strip and of the amplitude of any waves in the strip. As the straightened metal strip 5 is coiled up on a succeeding reel, the resulting bending of the strip should not displace the neutral line of the inherent stresses of the strip from the neutral zone of the strip. For this reason the neutral line of the inherent stresses of the strip to be coiled up must be displaced to a corresponding extent from the neutral zone in the opposite sense before the strip is coiled up. This is accomplished by straightening roller 4 imparting to the strip a longitudinal curvature in a sense which is opposite to the sense in which the strip is curved as it is coiled up. As it is not possible to detect the longitudinal curvature of a tensioned strip and the longitudinal curvature results in a transverse curvature, the longitudinal curvature which will be developed by the strip when it is free to spring back can be ascertained only by a detection of the transverse curvature of the strip when the same is tensioned. The straightening roller 4 must be moved to such a position of engagement that the desired transverse curvature is indicated by the actual-value signal generator 15. If the properties of the material of the strip and its tension are known, the transverse curvature of the strip which is related to a given longitudinal curvature of the strip can be computed in dependence on the instantaneous coil diameter. This computation is carried out in the computer 16, which is fed at its input 19 with the required data and which in accordance with the preselected program computes the varying desired transverse curvature of the strip in dependence on the continously changing diameter of the coil on the reel and delivers a corresponding desired-value signal to the controller 14. It is apparent that the position of engagement of the straightening roller can be automatically controlled in dependence on a comparison between these desired and actual values.

As the straightened strip 5 is not planar but has been given a longitudinal curvature so that the neutral line of the inherent stresses in the strip has been displaced from the center of the strip, the opposite longitudinal curvature imparted to the strip as it is coiled up will cause the neutral line of the inherent stresses in the strip to return to the center of the strip. When a strip which has thus been treated is uncoiled, it will be planar and need not be re-straightened.

What is claimed is:

1. In a plant for producing a coil of metal strip, wherein a longitudinal curvature in one sense is imparted to successive portions of a straightened metal strip by coiling said successive metal strip portions, each one of said coil portions having a diameter and said longitudinal curvature depending on said coil portion diameter; said plant comprising (a) a straightening roller arranged to be positioned in engagement with said metal strip along a path through which said successive metal strip portions are guided to impart a transverse curvature to said strip, said transverse curvature having a value determined by said engagement position of said straightening roller, (b) means arranged downstream of said straightening roller for detecting said transverse curvature value, (c) means for controlling said engagement position of said straightening roller by said detected value, (d) a computer computing a desired value of said transverse curvature, and (e) control means acting upon said engagement position controlling means to move said straightening roller until said detected transverse curvature value equals said desired value whereby a longitudinal curvature equal to, and in a sense opposite to the sense of, said longitudinal curvature of said coiled metal strip portion is imparted to said successive portions before said metal strip is coiled.

2. In the plant of claim 1, a stretching and bending metal strip straightening apparatus comprising upstream and downstream sets of tensioning rollers for tensioning said metal strip, and two bending rollers spaced apart along said path of the strip between said upstream and downstream sets of tensioning rollers, said straightening roller being arranged between said bending rollers and said downstream set of tensioning rollers, said means for detecting the transverse curvature value being arranged downstream of said downstream set of tensioning rollers and being a signal generator generating a signal corresponding to said value, said engagement position controlling means being a drive for positioning said straightening roller in relation to said metal strip, said control means acting upon said drive, and said computer computing said desired value of said transverse curvature downstream of said downstream set of tensioning rollers, said computer being programmed to compute said value as a function of said coil diameter, the properties of the material of said strip and the tension of said metal strip downstream of said downstream set of tensioning rollers, said control means being operatively connected to said computer.

* * * * *